US008161845B2

(12) United States Patent
Idir

(10) Patent No.: US 8,161,845 B2
(45) Date of Patent: Apr. 24, 2012

(54) TOOL FOR ASSEMBLING AND DISASSEMBLING A RESILIENT COLLAR

(75) Inventor: Hadi Idir, Sevran (FR)

(73) Assignee: Stanley Works (Europe) GmbH, Dubendorf (CH)

( * ) Notice: Subject to any disclaimer, the term of this patent is extended or adjusted under 35 U.S.C. 154(b) by 193 days.

(21) Appl. No.: 12/448,817

(22) PCT Filed: Dec. 21, 2007

(86) PCT No.: PCT/FR2007/002153

§ 371 (c)(1),
(2), (4) Date: Aug. 24, 2009

(87) PCT Pub. No.: WO2008/096077

PCT Pub. Date: Aug. 14, 2008

(65) Prior Publication Data

US 2010/0071514 A1 Mar. 25, 2010

(30) Foreign Application Priority Data

Jan. 12, 2007 (FR) ..... 07 00246

(51) Int. Cl.
*B25B 27/02* (2006.01)

(52) U.S. Cl. ..... 81/9.3; 81/426; 81/486

(58) Field of Classification Search ..... 81/9.3, 81/486, 426, 426.5

See application file for complete search history.

(56) References Cited

U.S. PATENT DOCUMENTS

| | | | | |
|---|---|---|---|---|
| 4,884,432 | A * | 12/1989 | Watson | 81/9.3 |
| 5,209,143 | A * | 5/1993 | Sweet | 81/9.3 |
| 5,590,573 | A | 1/1997 | Detable | |
| 6,098,508 | A * | 8/2000 | Battistone | 81/416 |
| 7,313,984 | B1 * | 1/2008 | Eggert et al. | 81/9.3 |

FOREIGN PATENT DOCUMENTS

| | | |
|---|---|---|
| DE | 295 15 050 | 11/1995 |
| DE | 44 40 210 | 5/1996 |
| EP | 0 677 357 | 10/1995 |

* cited by examiner

*Primary Examiner* — Hadi Shakeri
(74) *Attorney, Agent, or Firm* — Wenderoth, Lind & Ponack, L.L.P.

(57) ABSTRACT

According to the invention, a tool for assembling and disassembling an elastic collar includes first and second jaws mobile relative to each other. The first and second jaws respectively include first gripping profiles, the first gripping profiles being adapted to interact with the elastic collar and being provided opposite each other along a first predetermined and general collar-gripping orientation relative to the jaws. The first and second jaws respectively include at least second gripping profiles, the second gripping profiles being provided opposite each other and being adapted to interact with the elastic collar along a second predetermined general gripping orientation relative to the jaws, the second orientation being different from the first orientation.

17 Claims, 4 Drawing Sheets

TOOL FOR ASSEMBLING AND DISASSEMBLING A RESILIENT COLLAR

BACKGROUND OF THE INVENTION

The invention relates to a tool for assembling and disassembling a resilient clamping collar on a tubular member. The collar is closed in a loop comprising two ends, suitable for being mutually engaged, and the tool is of the type comprising first and second jaws, movable relative to one another to assemble and disassemble the collar. The first jaw comprises a first gripping profile suitable for co-operating with one of the two ends of the resilient collar, and the second jaw comprises a first gripping profile suitable for co-operating with the other of the two ends of the resilient collar. The first profiles of the first and second jaws are arranged facing each other in a first predetermined and general collar-gripping orientation relative to the jaws of the tool, and are suitable for co-operating with one of the ends of the resilient collar to assemble and disassemble the collar.

The fitting and removal of a resilient collar with a pincer-type tool comprising a first jaw and a second jaw articulated on a pivot is known on the one hand, from document EP-A1-0 224 317.

The resilient collar in question is a closed loop and comprises two ends, one of which comprises a radial projection and the other a hook suitable for being locked on the radial projection so as to close the resilient collar round a tubular member of the flexible pipe type. The first and second jaws of the tool have different profiles which co-operate with one of the ends of the collar. When turned over, the tool allows the engagement of the jaws relative to the respective ends of the collar to be reversed, thus allowing the ends of the collar to be locked or unlocked in order to assemble or disassemble the tubular member.

However, this tool is difficult to manipulate when assembling and disassembling the collar in difficult-to-access places.

On the other hand, Caillau pliers reference 0260 comprising two parallel closing jaws, on each of which an interchangeable orientable end piece allows resilient collars to be manipulated in difficult-to-access places.

However, orientation of the interchangeable end pieces is performed independently with a nut and bolt system on each of the jaws of the pliers. This makes it complex to manipulate and precisely orient the end pieces opposite one another.

An object of the invention is to design a simple tool for assembling and/or disassembling a resilient clamping collar, while allowing the resilient collars to be manipulated easily in difficult-to-access places.

SUMMARY OF THE INVENTION

Accordingly, the invention relates to a tool for assembling and disassembling a resilient collar of the above-mentioned type, in which the first and second jaws comprise respectively at least a second gripping profile. The two corresponding profiles are arranged facing each other and are suitable for co-operating with one of the ends of the resilient collar to assemble or disassemble the collar. The second profiles of the first and second jaws are arranged in a second predetermined and general orientation relative to the jaws of the tool, the second orientation being different from the first orientation.

According to other features:

- each jaw comprises two gripping profiles each arranged respectively on each leg of an L shape;

- each jaw comprises three gripping profiles each arranged respectively on two end portions and an intermediate portion of a U shape;
- each first gripping profile of the first jaw comprises a guiding chamfer and a centering notch designed respectively to guide and/or center one of the ends of the resilient collar, and
- each first profile of the second jaw comprises a hollowed tip with a taper, the assembly and disassembly operations being performed by engaging the first and second jaws in reversed positions with the ends of the collar;
- each jaw comprises identical gripping profiles;
- each jaw is produced from thick steel sheet, the gripping profiles being integral with each jaw;
- the tool is configured as pliers comprising a joint connecting two arms in scissors-fashion, the arms having respectively a handle and a jaw;
- the tool comprises a cable mechanism for remote actuation of the first and second jaws.

The invention also relates to a unit made up of at least a resilient clamping collar, closed in a generally circular loop, comprising two ends. One of the ends comprises a radial locking projection extending as an external protrusion, and the other end comprises a locking hook co-operating with the radial projection to resiliently and reversibly connect the two ends of the collar to one another. The unit is also made up of a tool as described below.

According to another feature, the end of the resilient collar having the radial projection also comprises on the side of the projection opposite the associated end of the collar, a boss extending radially outwards. The guiding and/or centering notch of each gripping profile of the second jaw co-operates with the boss in the collar disassembly phase.

BRIEF DESCRIPTION OF THE DRAWINGS

The invention will now be described, in a non-limiting fashion, with reference to the accompanying drawings, in which.

DETAILED DESCRIPTION OF THE INVENTION

Figure 1:
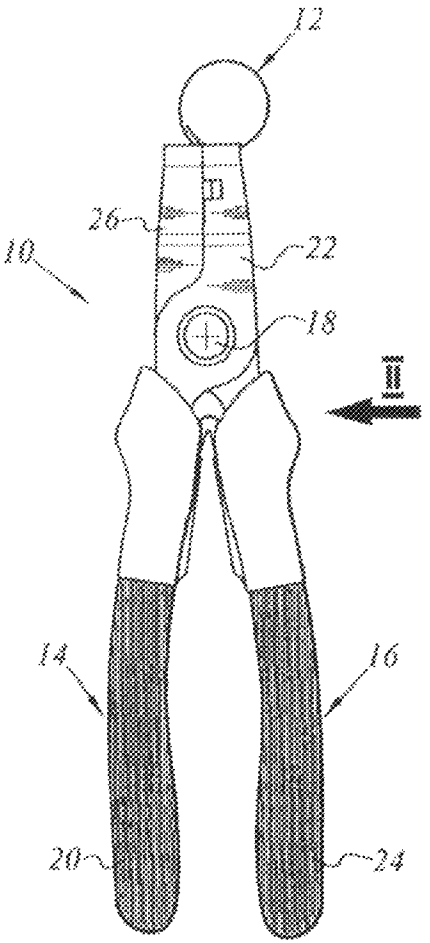
FIG. 1 is a front view of the tool according to the invention illustrating a first general collar-gripping orientation relative to the jaws of the tool.

In FIG. 1, a tool 10 according to the invention is illustrated gripping a resilient clamping collar 12, the collar being designed for clamping on a tubular member such as a flexible pipe arranged in the engine compartment of a motor vehicle. The tool 10 comprises a first arm 14 and a second arm 16 connected by a scissors-type pivot joint 18. The first arm 14 comprises a first handle 20 and a first jaw 22 arranged on either side of the pivot joint 18. Similarly, the second arm 16 comprises a second handle 24 and a second jaw 26 arranged on either side of the pivot joint 18.

In the example illustrated, the tool 10 extends in a general plane represented by the plane in FIG. 1. The collar 12 is closed in a generally circular loop, and is arranged in a general plane substantially parallel to the general plane of the tool 10. The first jaw 22 and the second jaw 26 are configured in such a way that a mutual bringing together of the handles 20 and 24 tends to bring the jaws 22 and 26 closer to one another.

Figure 10:
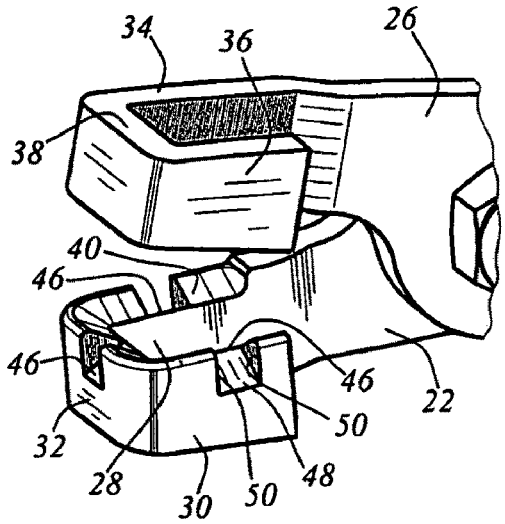
FIG. 10 is a perspective view on an enlarged scale showing the profile of the first jaw of the tool according to the invention.
Figure 11:
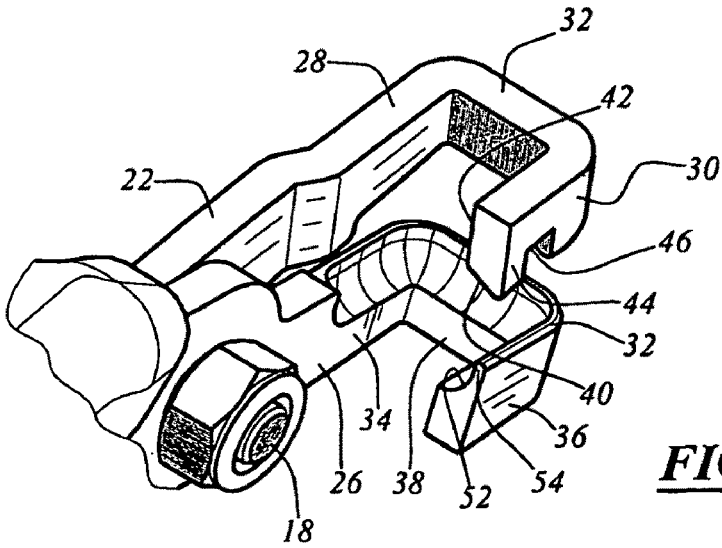
FIG. 11 is a perspective view on an enlarged scale showing the profile of the second jaw of the tool according to the invention.

As can be seen in FIGS. 10 and 11, the first jaw 22 is generally U-shaped. It comprises a first length (leg) 28 and a second length (leg) 30, which are substantially parallel to each other and parallel to the general plane of the tool 10, and are connected by an intermediate length (leg) 32 substantially perpendicular to the lengths (legs) 28 and 30.

The second jaw 26 is generally U-shaped similar to the first jaw 26. It too comprises a first length (leg) 34 and a second length (leg) 36, substantially parallel to each other and parallel to the general plane of the tool 10, connected by an intermediate length (leg) 38 substantially perpendicular to the lengths (legs) 34 and 36.

The first and second jaws 22 and 26 are produced, preferably, from thick metal sheet.

The first jaw 22 comprises an inner chamfer 40 arranged along the entire length of U shape and facing the second jaw 26. The chamfer 40 is inclined in the thickness of the metal sheet forming the first jaw 22, in such a way that, seen in cross section (FIG. 11), the inner face 42 has a lower height than the outer U-shaped face 44 of the first jaw 22.

A notch 46, centered on each of the lengths 28, 30 and 32 of the first jaw 22, has a bottom face 48 surrounded by two side faces 50.

The face 48 of each notch 46 is oriented in such a way that it forms an acute angle with the inner face 42 of the first jaw 22. The chamfer 40 is oriented in such a way that it forms an acute angle with the outer face 44 of the first jaw 22 (FIG. 5 to FIG. 9).

The second jaw 26 has a continuous recess 52 of quadrant-shaped cross-section on the inner periphery of the U. This recess forms the inner face of a tapered tip 54 oriented towards the jaw 22.

The same tool 10, comprising U-shaped jaws, comprises three pairs of gripping profiles integral with the jaws, that is to say a pair on each length of the U. Each pair has a chamfered profile 40 provided with a notch 46 arranged in the first jaw 22, and a hollowed profile 52 with a tapered tip 54 on the second jaw 26.

Figure 2:
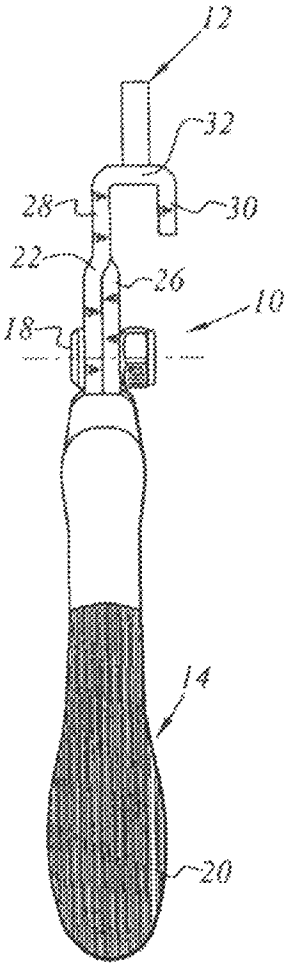
FIG. 2 is a side view of the tool along the arrow II of FIG. 1 showing the first general gripping orientation.
Figure 3:
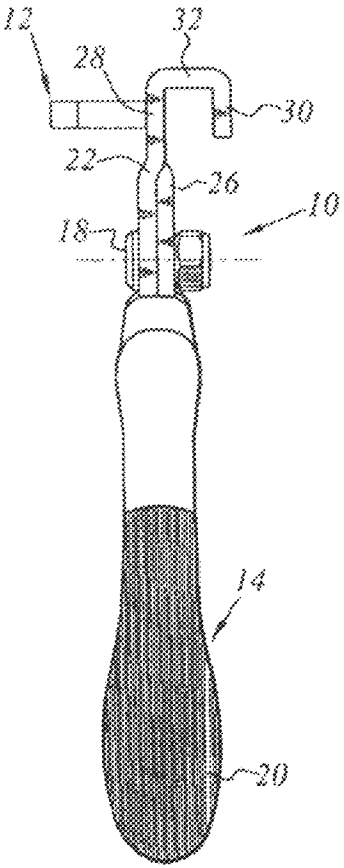
FIG. 3 is a similar view to FIG. 2 showing a second general collar-gripping orientation relative to the jaws of the tool.
Figure 4:
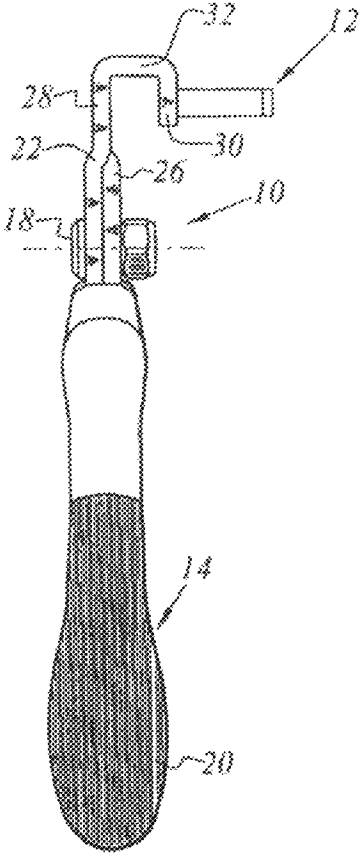
FIG. 4 is a similar view to FIG. 2 showing a third general collar-gripping orientation relative to the jaws of the tool.
Figure 5:
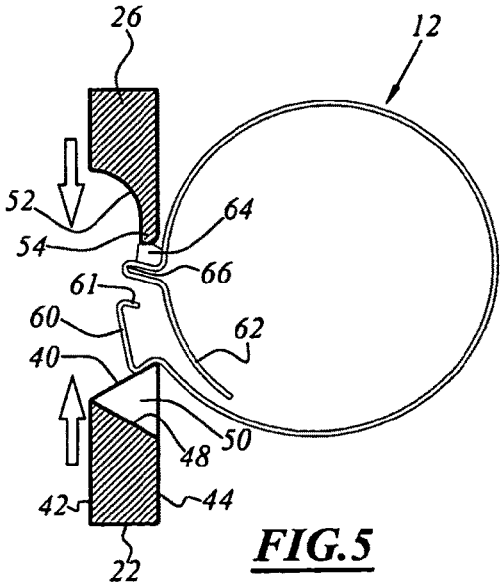
FIGS. 5 to 9 illustrate successively the phases of locking and unlocking a resilient collar using a tool according to the invention.

Thus, as illustrated in FIGS. 2 to 4, a resilient clamping collar can be gripped by the jaws of the tool 10 in three different predetermined and general orientations.

In fact, the intermediate lengths 32 and 38 of the U shapes of the first 22 and second 26 jaws allow the collar 12 to be oriented substantially parallel to the general plane of the tool 10. The lengths 30 and 36 arranged at the free end of the U shapes of the first 22 and second 26 jaws allow a second general gripping orientation of the collar 12 substantially perpendicular to the general plane of the tool 10. The lengths 28 and 34 of the U shapes of the first 22 and second 26 jaws arranged close to the pivot joint 18 allow a third general gripping orientation of the collar 12 substantially perpendicular to the general plane of the tool 10 and oriented the opposite way with respect to the second general gripping orientation of the collar 12.

According to FIGS. 5 to 9, the collar 12 is closed in a loop. It comprises, in a known manner, a first end 60 in the form of a trapezoidal hook which ends in an inward curving tip 61, and a second end 62 in which an outer boss 64 and a substantially radial outer projection 66 are formed. The boss 64 is adjacent to the face of the projection 66 opposite the end 62 of the collar.

Figure 6:
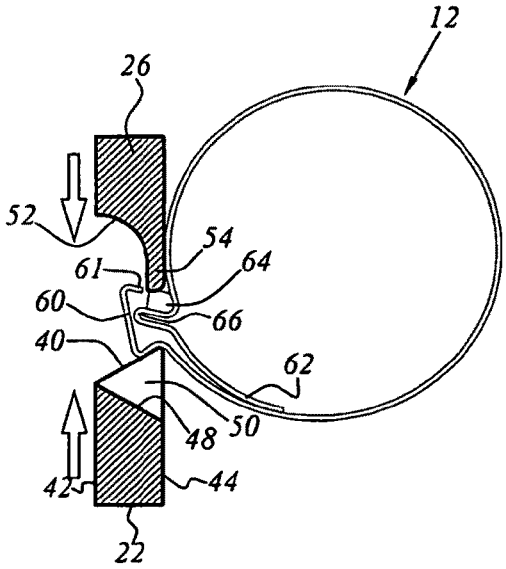

To assemble the collar 12 in order to fix a tubular member, such as a flexible pipe on an engine element of a motor vehicle, the collar 12, in the unlocked and open state, is placed on the tubular member. The jaws 22 and 26 of the tool 10 are arranged close to the hook 60 and the boss 64, in such a way that the chamfer 40 of the first jaw 22 is placed resting behind the hook 60, and the tapered tip 54 of the second jaw comes in contact with the boss 64. In this configuration, the radial projection 66 is positioned between the hook 60 and the boss 64 of the collar 12. An action on the arms 20 and 24 of the tool 10 tending to bring them closer together leads to a movement of the jaws 22 and 26 towards each other, as indicated by the arrows in FIG. 5. By continuing this movement of bringing together the jaws 22 and 26, the hook 60 resiliently passes over the radial projection 66 as illustrated in FIG. 6.

An action on the arms 20 and 24 of the tool 10 tending to move the first tip 22 away from the second tip 26 causes the hook 60 to lock on the radial projection 66, the curved tip 61 of the hook 60 being engaged the said radial projection. The collar 12 is in the locked and closed state as shown in FIG. 7.

From this state, to open and disassemble the collar 12 of the tubular member, the tool 10 is turned over so as to reverse the engagement of the jaws 22 and 26 on the rear portion of the hook 60 and the rear portion of the boss 64.

Figure 7:
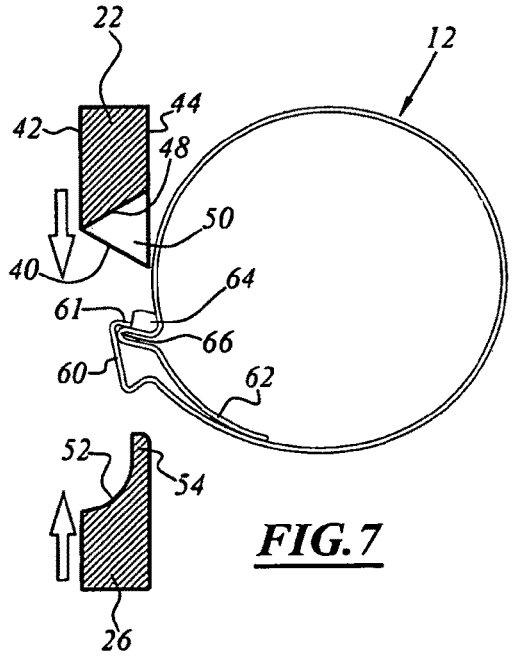

A movement tending to bring the jaws 22 and 26 closer together, as indicated by the arrows in FIG. 7, allows the chamfered edge 40 and the face 48 of the notch 46 of the first jaw 22 to be presented facing the boss 64 of the collar 12, and the tapered tip 54 of the second jaw 26 facing the rear portion of the hook 60.

Figure 8:
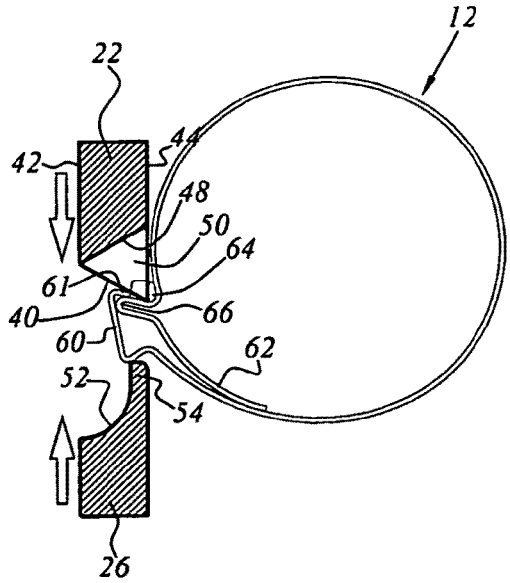

By continuing the movement tending to bring the jaws 22 and 26 closer to each other, the boss 64 is centered between the side walls 50 of the notch 46, and the chamfer 40 comes in contact with the radial projection 66 and the curved tip 61 of the hook 60, as illustrated in FIG. 8. An additional movement of bringing together the jaws 22 and 26 causes the curved tip 61 to be guided along the slope of the chamfer 40 towards the inner face 42, and disengages the curved tip 61 from engagement with the radial projection 66.

Figure 9:
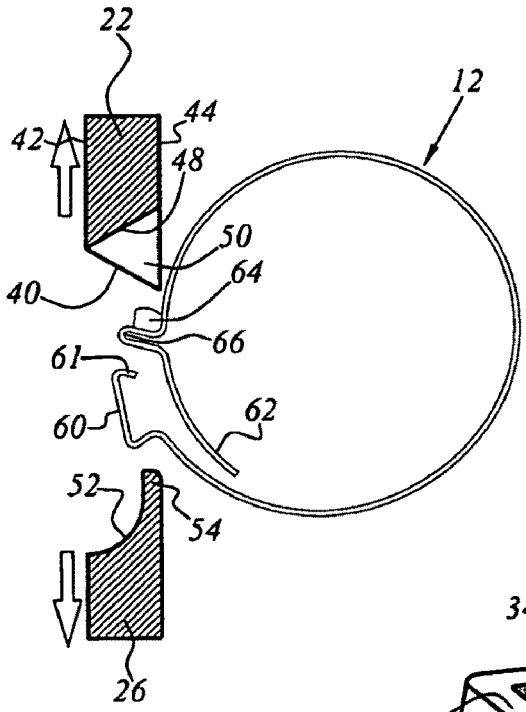

A movement tending to move the jaws 22 and 26 away from each other, as indicated by the arrows of FIG. 9, then allows the first end 60 and the second end 62 of the collar 12 to be disconnected, and thus opened.

Figure 12:
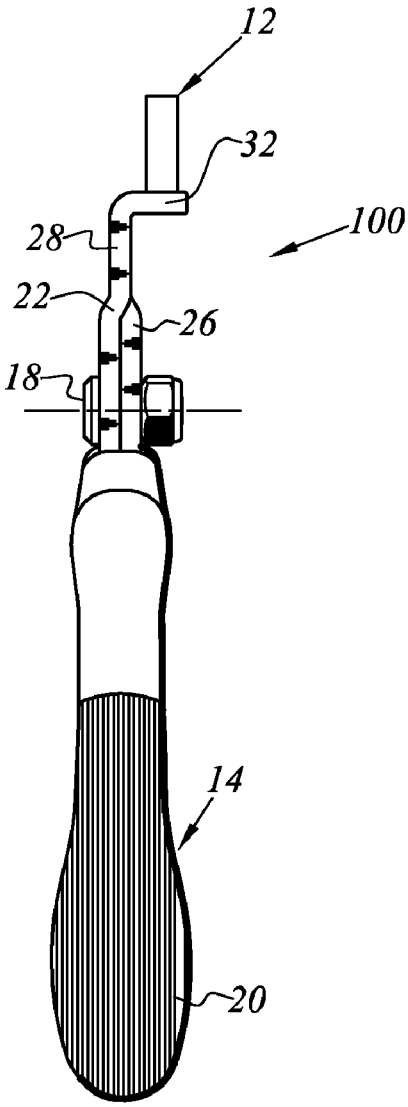
FIG. 12 is a side view of the tool similar to FIG. 2, but showing a variant in which the jaws are L-shaped.

The invention has been described with U-shaped jaws. However, according to a variant shown in FIG. 12, the tool 100 can have an L-shaped jaw comprising a gripping profile arranged on each leg (first leg and second leg) of the L allows two predetermined and general gripping orientations of a resilient collar. One of the orientations is substantially parallel to the general plane of the tool, and the other is substantially perpendicular to the general plane of the tool.

Figure 13:
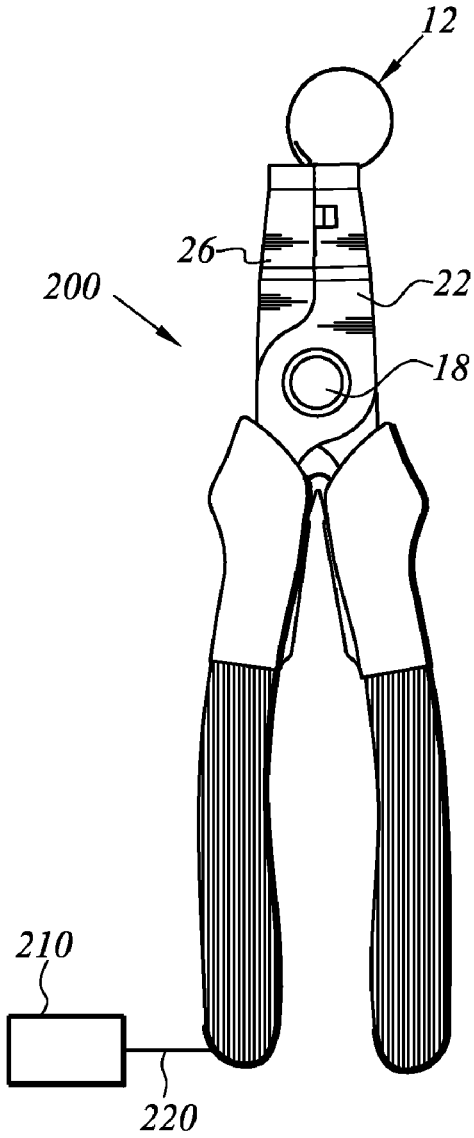
FIG. 13 is a front view of the tool similar to FIG. 1, but showing a variant including a cable actuating mechanism.

The invention has been described above with a pliers-type tool comprising two articulated arms each comprising a jaw and a handle. According to a variant shown in FIG. 13, the tool 200 can comprise a set of articulated jaws remote from a set of handles that are also articulated, the two sets being connected by a cable actuating mechanism 210, 220. Due to the invention, it is possible to manipulate a resilient clamping collar in difficult-to-access places with a simple tool that has a plurality of general collar-gripping orientations.

The invention claimed is:

1. A tool for assembling and disassembling a resilient clamping collar on a tubular member, said tool comprising:

a first L-shaped jaw comprising a first leg substantially parallel to a plane of said tool and a second leg oriented at an angle to said first leg, said first leg and said second leg of said first L-shaped jaw being connected in succession, said first leg of said first L-shaped jaw having a first gripping profile, and said second leg of said first L-shaped jaw having a second gripping profile; and a second L-shaped jaw comprising a first leg substantially parallel to said plane of said tool and a second leg oriented at an angle to said first leg, said first leg and said second leg of said L-shaped jaw being connected in succession, said first leg of said second L-shaped jaw having a first gripping profile, and said second leg of said second L-shaped jaw having a second gripping profile, said first L-shaped jaw and said second L-shaped jaw being movable relative to one another so as to assemble and disassemble the clamping collar;

wherein said first gripping profile of said first leg of said first L-shaped jaw is configured to cooperate with a first one of two ends of the clamping collar;

wherein said first gripping profile of said first leg of said second L-shaped jaw is configured to cooperate with a second one of the two ends of the clamping collar;

wherein said first gripping profile of said first leg of said first L-shaped jaw and said first gripping profile of said first leg of said second L-shaped jaw are arranged to face each other in a first predetermined collar-gripping orientation;

wherein said second gripping profile of said second leg of said first L-shaped jaw and said second gripping profile of said second leg of said second L-shaped jaw are arranged to face each other in a second predetermined collar-gripping orientation, said second predetermined orientation being different from said first predetermined orientation;

wherein said first gripping profile of said first leg of said first L-shaped jaw comprises a guiding chamfer and a centering notch for guiding and centering the first one of the two ends of the clamping collar;

wherein said first gripping profile of said first leg of said second L-shaped jaw comprises a hollow tip having a tapered shape;

wherein said second gripping profile of said second leg of said first L-shaped jaw comprises a guiding chamfer and a centering notch for guiding and centering the first one of the two ends of the clamping collar; and wherein said second gripping profile of said second leg of said second L-shaped jaw comprises a hollow tip having a tapered shape.

2. The tool according to claim 1, wherein each of said second leg of said first L-shaped jaw and said second leg of said second L-shaped jaw is substantially perpendicular to the plane of said tool.

3. The tool according to claim 1, wherein each of said first L-shaped jaw and said second L-shaped jaw is produced from a steel sheet, said first gripping profile and said second gripping profile being integral with each of said first L-shaped jaw and said second L-shaped jaw.

4. The tool according to claim 1, wherein said tool comprises pliers including two arms connected at a pivot joint in scissors-fashion, a first one of said two arms having a handle and said first L-shaped jaw, and a second one of said two arms having a handle and said second L-shaped jaw.

5. The tool according to claim 1, further comprising a cable mechanism for remote actuation of said first L-shaped jaw and said second L-shaped jaw.

6. A clamping unit comprising:

a resilient clamping collar shaped to form a closed loop having a substantially circular shape and two ends, a first one of said two ends comprising a radial locking projection extending as an external protrusion, and a second one of said two ends comprising a locking hook cooperating with said radial locking projection to resiliently and reversibly connect said two ends to one another; and a tool for assembling and disassembling said clamping collar on a tubular member, said tool including:

a first L-shaped jaw comprising a first leg substantially parallel to a plane of said tool and a second leg oriented at an angle to said first leg, said first leg and said second leg of said first L-shaped jaw being connected in succession, said first leg of said first L-shaped jaw having a first gripping profile, and said second leg of said first L-shaped jaw having a second gripping profile; and a second L-shaped jaw comprising a first leg substantially parallel to said plane of said tool and a second leg oriented at an angle to said first leg, said first leg and said second leg of said L-shaped jaw being connected in succession, said first leg of said second L-shaped jaw having a first gripping profile, and said second leg of said second L-shaped jaw having a second gripping profile, said first L-shaped jaw and said second L-shaped jaw being movable relative to one another so as to assemble and disassemble said clamping collar;

wherein said first gripping profile of said first leg of said first L-shaped jaw is configured to cooperate with said first one of said two ends of said clamping collar;

wherein said first gripping profile of said first leg of said second L-shaped jaw is configured to cooperate with said second one of said two ends of said clamping collar;

wherein said first gripping profile of said first leg of said first L-shaped jaw and said first gripping profile of said first leg of said second L-shaped jaw are arranged to face each other in a first predetermined collar-gripping orientation;

wherein said second gripping profile of said second leg of said first L-shaped jaw and said second gripping profile of said second leg of said second L-shaped jaw are arranged to face each other in a second predetermined and collar-gripping orientation, said second predetermined orientation being different from said first predetermined orientation;

wherein said first gripping profile of said first leg of said first L-shaped jaw comprises a guiding chamfer and a centering notch for guiding and centering said first one of said two ends of said clamping collar;

wherein said first gripping profile of said first leg of said second L-shaped jaw comprises a hollow tip having a tapered shape;

wherein said second gripping profile of said second leg of said first L-shaped jaw comprises a guiding chamfer and a centering notch for guiding and centering the first one of said two ends of said clamping collar; and wherein said second gripping profile of said second leg of said second L-shaped jaw comprises a hollow tip having a tapered shape.

7. The clamping unit according to claim 6, wherein said first gripping profile of said first leg of said first L-shaped jaw comprises a guiding chamfer and a centering notch for guiding and centering said first one of said ends of the clamping collar;

wherein said first gripping profile of said first leg of said second L-shaped jaw comprises a hollow tip having a tapered shape;

said first one of said two ends further comprises, on a side of said projection opposite an associated end of said clamping collar, a boss extending radially outwards; and wherein said centering notch of said first gripping profile of said first L-shaped jaw cooperates with said boss during disassembly of said clamping collar.

8. The clamping unit according to claim 6, wherein each of said second leg of said first L-shaped jaw and said second leg of said second L-shaped jaw is substantially perpendicular to the plane of said tool.

9. The clamping unit according to claim 6, wherein said first gripping profile and said second gripping profile of each of said first L-shaped jaw and said second L-shaped jaw are identical.

10. The clamping unit according to claim 6, wherein each of said first L-shaped jaw and said second L-shaped jaw is produced from a steel sheet, said first gripping profile and said second gripping profile being integral with each of said first L-shaped jaw and said second L-shaped jaw.

11. The clamping unit according to claim 6, wherein said tool comprises pliers including two arms connected at a pivot joint in scissors-fashion, a first one of said two arms having a handle and said first L-shaped jaw, and a second one of said two arms having a handle and said second L-shaped jaw.

12. The clamping unit according to claim 6, wherein said tool further includes a cable mechanism for remote actuation of said first L-shaped jaw and said second L-shaped jaw.

13. A tool for assembling and disassembling a resilient clamping collar on a tubular member, said tool comprising:

a first U-shaped jaw comprising a first leg substantially parallel to a plane of said tool, a second leg oriented at an angle to said first leg, and a third leg substantially parallel to said first leg, said first leg and said third leg of said first U-shaped jaw being connected to each other via said second leg of said first U-shaped jaw, said first leg of said first U-shaped jaw having a first gripping profile, said second leg of said first U-shaped jaw having a second gripping profile, and said third leg of said first U-shaped jaw having a third gripping profile; and a second U-shaped jaw comprising a first leg substantially parallel to said plane of said tool, a second leg oriented at an angle to said first leg, and a third leg substantially parallel to said first leg, said first leg and said third leg of said second U-shaped jaw being connected to each other via said second leg of said second U-shaped jaw, said first leg of said second U-shaped jaw having a first gripping profile, said second leg of said second U-shaped jaw having a second gripping profile, and said third leg of said second U-shaped jaw having a third gripping profile, said first U-shaped jaw and said second U-shaped jaw being movable relative to one another so as to assemble and disassemble the clamping collar;

wherein said first gripping profile of said first leg of said first U-shaped jaw is configured to cooperate with a first one of two ends of the clamping collar;

wherein said first gripping profile of said first leg of said second U-shaped jaw is configured to cooperate with a second one of the two ends of the clamping collar;

wherein said first gripping profile of said first leg of said first U-shaped jaw and said first gripping profile of said first leg of said second U-shaped jaw are arranged to face each other in a first predetermined collar-gripping orientation;

wherein said second gripping profile of said second leg of said first U-shaped jaw and said second gripping profile of said second leg of said second U-shaped jaw are arranged to face each other in a second predetermined and collar-gripping orientation, said second predetermined orientation being different from said first predetermined orientation;

wherein said third gripping profile of said third leg of said first U-shaped jaw and said third gripping profile of said third leg of said second U-shaped jaw are arranged to face each other in a third predetermined and collar-gripping orientation, said third predetermined orientation being different from both said first predetermined orientation and said second predetermined orientation;

wherein said first gripping profile of said first leg of said first U-shaped jaw comprises a guiding chamfer and a centering notch for guiding and centering the first one of the two ends of the clamping collar;

wherein said first gripping profile of said first leg of said second U-shaped jaw comprises a hollow tip having a tapered shape;

wherein said second gripping profile of said second leg of said first U-shaped jaw comprises a guiding chamfer and a centering notch for guiding and centering the first one of the two ends of the clamping collar;

wherein said second gripping profile of said second leg of said second U-shaped jaw comprises a hollow tip having a tapered shape;

wherein said third gripping profile of said third leg of said first U-shaped jaw comprises a guiding chamfer and a centering notch for guiding and centering the first one of the two ends of the clamping collar; and wherein said third gripping profile of said third leg of said second U-shaped jaw comprises a hollow tip having a tapered shape.

14. The tool according to claim 13, wherein each of said second leg of said first U-shaped jaw and said second leg of said second U-shaped jaw is substantially perpendicular to the plane of said tool.

15. The tool according to claim 13, wherein each of said first U-shaped jaw and said second U-shaped jaw is produced from a steel sheet, said first gripping profile, said second gripping profile, and said third gripping profile being integral with each of said first U-shaped jaw and said second U-shaped jaw.

16. The tool according to claim 13, wherein said tool comprises pliers including two arms connected at a pivot joint in scissors-fashion, a first one of said two arms having a handle and said first U-shaped jaw, and a second one of said two arms having a handle and said second U-shaped jaw.

17. The tool according to claim 13, further comprising a cable mechanism for remote actuation of said first U-shaped jaw and said second U-shaped jaw.

* * * * *